US008720704B2

(12) United States Patent
Gupta

(10) Patent No.: US 8,720,704 B2
(45) Date of Patent: May 13, 2014

(54) MODULAR STORAGE AND DISPLAY SYSTEM

(76) Inventor: Anil K. Gupta, Pittsburgh, PA (US)

( * ) Notice: Subject to any disclaimer, the term of this patent is extended or adjusted under 35 U.S.C. 154(b) by 0 days.

(21) Appl. No.: 13/413,895

(22) Filed: Mar. 7, 2012

(65) Prior Publication Data

US 2013/0233814 A1 Sep. 12, 2013

(51) Int. Cl.
*A47B 73/00* (2006.01)
*A47F 5/08* (2006.01)

(52) U.S. Cl.
USPC ..... 211/74; 211/90.02; 248/243

(58) Field of Classification Search
USPC ..... 211/74, 75, 90.01, 90.02, 90.04, 94.01, 211/103, 105.1–105.4, 175, 187, 190, 193, 211/207, 208; 248/235, 239, 247, 250; 108/106–110, 147.17
See application file for complete search history.

(56) References Cited

U.S. PATENT DOCUMENTS

| | | | | | |
|---|---|---|---|---|---|
| 1,035,967 | A | * | 8/1912 | Keil | 248/250 |
| 2,015,620 | A | * | 9/1935 | Cuthbert | 211/96 |
| 2,512,203 | A | * | 6/1950 | Fluharty | 211/123 |
| 2,534,952 | A | * | 12/1950 | Comer | 248/243 |
| 2,900,085 | A | * | 8/1959 | Levy | 108/1 |
| 2,971,657 | A | * | 2/1961 | Zadek | 108/147.17 |
| 2,975,908 | A | * | 3/1961 | Huet | 108/185 |
| 3,018,900 | A | * | 1/1962 | Huet | 211/193 |
| 3,057,483 | A | * | 10/1962 | Derman | 211/193 |
| 3,085,693 | A | * | 4/1963 | Shell | 211/134 |
| 3,184,068 | A | * | 5/1965 | Wende | 211/23 |
| 3,233,852 | A | * | 2/1966 | Azar | 248/68.1 |
| 3,313,424 | A | * | 4/1967 | Gingher | 211/113 |
| 3,556,306 | A | * | 1/1971 | Shell | 211/90.02 |
| 3,830,375 | A | * | 8/1974 | Larson | 211/59.1 |
| 4,098,480 | A | * | 7/1978 | Neumann | 248/243 |
| 5,116,007 | A | * | 5/1992 | Von Gunton et al. | 248/243 |
| 5,253,837 | A | * | 10/1993 | Loux | 248/250 |
| 5,429,252 | A | * | 7/1995 | Liu | 211/94.01 |
| 5,477,789 | A | * | 12/1995 | Von Gunten | 108/108 |
| 5,697,507 | A | * | 12/1997 | Blass | 211/94.01 |
| 5,797,501 | A | * | 8/1998 | Von Gunten | 211/90.01 |
| 6,109,461 | A | * | 8/2000 | Kluge et al. | 211/90.01 |
| 6,179,136 | B1 | * | 1/2001 | Kluge et al. | 211/90.01 |
| 6,644,609 | B1 | * | 11/2003 | Scott | 248/243 |
| 6,729,481 | B1 | * | 5/2004 | O'Brien | 211/74 |
| D497,526 | S | * | 10/2004 | Sanders et al. | D7/707 |
| 6,991,117 | B2 | * | 1/2006 | McCain | 211/75 |
| 7,651,065 | B2 | * | 1/2010 | Sloan | 248/339 |
| 7,967,268 | B2 | * | 6/2011 | Herron et al. | 248/243 |
| 8,038,021 | B2 | * | 10/2011 | Chen | 211/192 |
| 8,231,015 | B2 | * | 7/2012 | McCain | 211/74 |
| D673,840 | S | * | 1/2013 | Drobot et al. | D8/381 |

(Continued)

*Primary Examiner* — Joshua Rodden
(74) *Attorney, Agent, or Firm* — James Ray & Assoc

(57) ABSTRACT

The present invention provides a modular system for at least one of displaying and storing at least one article. The modular system includes at least a pair of elongated support brackets; at least one elongated cross member and means for positioning each of the at least one elongated cross member and the at least said pair of elongated support brackets in a generally horizontal plane during use of the modular system. The at least a pair of elongated support brackets are disposed in a spaced apart parallel relationship with each other. The at least one elongated cross member is sized to at least span a distance between the at least pair of elongated support brackets. Additionally, the at least one elongated cross member may at least rest on a top edge of each of the at least the pair of elongated support brackets during use of said modular system.

27 Claims, 8 Drawing Sheets

(56) References Cited

U.S. PATENT DOCUMENTS

| | | | | |
|---|---|---|---|---|
| 2002/0153337 | A1* | 10/2002 | Shuen | 211/123 |
| 2006/0043038 | A1* | 3/2006 | Wetzel et al. | 211/88.03 |
| 2007/0221103 | A1* | 9/2007 | Trausch | 108/108 |
| 2008/0184475 | A1* | 8/2008 | Sladick et al. | 4/576.1 |
| 2008/0203040 | A1* | 8/2008 | Kologe | 211/103 |
| 2009/0139943 | A1* | 6/2009 | Fernandez | 211/94.01 |
| 2010/0252521 | A1* | 10/2010 | Chen | 211/208 |
| 2011/0132853 | A1* | 6/2011 | Drobot et al. | 211/42 |
| 2011/0155677 | A1* | 6/2011 | Fernandez et al. | 211/86.01 |
| 2012/0085721 | A1* | 4/2012 | Michael J. et al. | 211/103 |
| 2012/0273444 | A1* | 11/2012 | McCain | 211/75 |
| 2012/0292277 | A1* | 11/2012 | Chikkakalbalu | 211/94.02 |

* cited by examiner

MODULAR STORAGE AND DISPLAY SYSTEM

CROSS-REFERENCE TO RELATED APPLICATIONS

N/A

FIELD OF THE INVENTION

The present invention relates, in general, to a modular system for at least one of displaying and storing at least one article and, more particularly, this invention relates to a modular system for at least one of displaying and storing wine bottles.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known traditional wine racks stored bottles of wine in square or circular compartments, to maximize the number of bottles that could be stored against a wall. These compartments extended orthogonally from the wall such that wine bottles were inserted base first, with only the mouth and cork of the bottle visible from the outside. This was problematic to a person trying to select a wine bottle from such a rack, because the label which distinguishes one wine bottle from another is on the body of the bottle, not at the mouth and cork.

Another problem with traditional wine racks is that they were not modular. Typical wine racks were built in large units that covered entire walls. This led to much wasted space for users who did not have enough wine to fill the rack. Modular wooden racks using dowels to create a rack enable the same kind of storage with bottles orthogonal to a wall with only the corks readily visible. However, this assembly method allowed as much wine rack as was needed for the available space.

Subsequent art in the wine rack field disclosed racks made of wood, wire, or metal. Some were modular, but others were decorative, with a predetermined number of storage spaces. These racks offered several advantages. The racks were cheaper to produce, lightweight, portable, and easy to install. However, these racks persisted in storing the wine orthogonal to the viewer. These iterations of wine racks did not solve the key problem of making the label visible to a viewer while the bottle was still in the rack.

All of the prior art racks and storage systems, to the best knowledge of the inventor, failed to enable display of wine bottles in combination with their storage and further enable display and/or storage of wine glasses, decanters and the like wine paraphernalia. Therefore, there is a need for an improved modular system for storing and displaying wine bottles and similarly elongated articles, for example, oil bottles, shampoo and/or conditioner bottles and containers and even shoes.

SUMMARY OF THE INVENTION

The invention provides a modular system for at least one of displaying and storing at least one article. The modular system includes at least a pair of elongated support brackets; at least one elongated cross member and means for positioning each of the at least one elongated cross member and the at least said pair of elongated support brackets in a generally horizontal plane during use of the modular system. The at least a pair of elongated support brackets are disposed in a spaced apart parallel relationship with each other. The at least one elongated cross member is sized to at least span a distance between the at least the pair of elongated support brackets. Additionally, the at least one elongated cross member may at least rest on a top edge of each of the at least the pair of elongated support brackets during use of said modular system.

Another embodiment of the present invention provides a modular system for at least one of displaying and storing at least one article. The modular system comprises at least a pair of elongated mounting members; a plurality of elongated cross members; a plurality of first support brackets; a plurality of second support brackets; at least a pair of third support brackets; and a plurality of protrusions disposed in a spaced apart relationship on a top edge of each of said at least said pair of third support brackets. The at least a pair of elongated mounting members are disposed generally vertically in a spaced apart parallel relationship with each other during use of said modular system. Additionally the plurality of first support brackets each extends generally horizontally from and normal to a respective one of the at least said pair of elongated mounting members. Additionally the plurality of first support brackets are sized so as to position at least one pair of the plurality of elongated cross members in a first spaced apart parallel relationship with each other, whereby a length of the at least one article is oriented generally normal to a length of the at least one pair of elongated cross members, whereby one end of the at least one article is supported on one of the at least one pair of elongated cross members and another end of the at least one article is supported on another one of the at least one pair of elongated cross members. The plurality of second support brackets each extend generally horizontally from and normal to said respective one of said at least said pair of elongated mounting members and are sized so as to position at least another pair of the plurality of elongated cross members in a second spaced apart parallel relationship with each other. The length of the at least one article is oriented along a length of the at least another pair of elongated cross members. Additionally, one longitudinal edge of each of the at least another pair of elongated cross members abuts a surface of the at least one article. Each of the at least a pair of third support brackets extends at an angle from the respective one of said at least said pair of elongated mounting members so that a distal end of said each of the at least said pair of third support brackets is disposed lower in a vertical direction then a proximal end thereof being disposed in close proximity to said respective one of the at least said pair of elongated mounting members. The plurality of protrusions are disposed in a spaced apart relationship on a top edge of each of the at least said pair of third support brackets, whereby at least a further pair of the plurality of elongated members positioned in a third spaced apart parallel relationship with each other on the top edge of each of said at least said pair of third support brackets positions said at least one article at an incline relative to a plane defined by said at least said pair of elongated mounting members. The system of this the present invention may also include a substantially planar shelf disposed on top of a pair of said elongated cross members.

An additional embodiment of the present invention is directed to a bracket for supporting at least a pair of elongated cross members of a modular system for at least one of displaying and storing at least one article. The bracket comprises an elongated body; a first end configured for attachment to a mounting member employed within said modular system; and means for at least temporarily fixing said at least pair of elongated cross members in a spaced apart parallel relationship with each other.

Yet another embodiment of the present invention is directed to a bracket for supporting a pair of elongated cross members of a modular system for at least one of displaying and storing at least one article. The bracket comprises an elongated body; a first end configured for attachment to a mounting member employed within the modular system; and a stop disposed on a longitudinally opposite second end of the elongated body, wherein a portion of the stop protrudes above one edge of said elongated body.

An alternative embodiment of the present invention is directed to an elongated cross member for a modular system for at least one of displaying and storing at least one article. The elongated cross member comprises an elongated body; and a pair of planar end stops.

Another embodiment of the present invention is directed to an elongated cross member for a modular system for at least one of displaying and storing at least one article. The elongated cross member comprises an elongated body; and a plurality of protrusions extending from a surface of the elongated body in a spaced apart relationship with each other.

Yet an additional embodiment of the present invention is directed to a modular system for at least one of displaying and storing at least one article. The modular system comprises at least a pair of elongated mounting members; a plurality of elongated cross members; a plurality of first support brackets; a plurality of second support brackets; at least a pair of third support brackets; a plurality of protrusions disposed in a spaced apart relationship on a top edge of each of said at least said pair of third support brackets; and means for attaching one end of each of said at least said plurality of elongated first support brackets, said plurality of elongated second support brackets, and said plurality of elongated third brackets to a respective one of said at least said pair of elongated mounting members. The at least a pair of elongated mounting members are disposed generally vertically in a spaced apart parallel relationship with each other during use of said modular system. Additionally the plurality of first support brackets each extends generally horizontally from and normal to a respective one of the at least said pair of elongated mounting members. Additionally the plurality of first support brackets are sized so as to position at least one pair of the plurality of elongated cross members in a first spaced apart parallel relationship with each other, whereby a length of the at least one article is oriented generally normal to a length of the at least one pair of elongated cross members, whereby one end of the at least one article is supported on one of the at least one pair of elongated cross members and another end of the at least one article is supported on another one of the at least one pair of elongated cross members. The plurality of second support brackets each extend generally horizontally from and normal to said respective one of said at least said pair of elongated mounting members and are sized so as to position at least another pair of the plurality of elongated cross members in a second spaced apart parallel relationship with each other. The length of the at least one article is oriented along a length of the at least another pair of elongated cross members. Additionally, one longitudinal edge of each of the at least another pair of elongated cross members abuts a surface of the at least one article. Each of the at least a pair of third support brackets extends at an angle from the respective one of said at least said pair of elongated mounting members so that a distal end of said each of the at least said pair of third support brackets is disposed lower in a vertical direction then a proximal end thereof being disposed in close proximity to said respective one of the at least said pair of elongated mounting members. The plurality of protrusions are disposed in a spaced apart relationship on a top edge of each of the at least said pair of third support brackets, whereby at least a further pair of the plurality of elongated members positioned in a third spaced apart parallel relationship with each other on the top edge of each of said at least said pair of third support brackets positions said at least one article at an incline relative to a plane defined by said at least said pair of elongated mounting members. The system may also include means for attaching one end of each of said at least pair of elongated support brackets to a respective one of said at least said pair of elongated mounting members. The attaching mean includes a plurality of apertures or cavities defined in each of said at least said pair of elongated mounting members in a spaced apart relationship with each other along a length thereof; at least one tab extending from said one end of said each of said at least said plurality of elongated first support brackets, said plurality of elongated second support brackets, and said plurality of elongated third brackets, said at least one tab is sized and shaped for insertion into one of said plurality of apertures or cavities; and a tension mechanism disposed at said one end of said each of said at least said plurality of elongated first support brackets, said plurality of elongated second support brackets, and said plurality of elongated third brackets, said tension mechanism being manually operable to remove slack between said one end of said each of said at least said plurality of elongated first support brackets, said plurality of elongated second support brackets, and said plurality of elongated third brackets and a mating surface of said respective one of said at least said pair of elongated mounting members.

OBJECTS OF THE INVENTION

It is, therefore, one of the primary objects of the present invention to provide a modular system for at least one of displaying and storing at least one article. The modular system includes at least a pair of elongated support brackets; at least one elongated cross member and means for positioning each of the at least one elongated cross member and the at least said pair of elongated support brackets in a generally horizontal plane during use of the modular system.

Another object of the present invention is to provide a modular system for at least one of displaying and storing at least one article that includes a pair of elongated cross members.

Yet another object of the present invention is to provide a modular system for at least one of displaying and storing at least one article that includes end stops of said pair of elongated cross members.

A further object of the present invention is to provide a modular system for at least one of displaying and storing the at least one article wherein at least one article is a plurality of articles and wherein said system further includes means for positioning at least a portion of said plurality of articles.

Yet a further object of the present invention is to provide a modular system for at least one of displaying and storing at least one article that further includes means for at least temporarily fixing said at least said pair of elongated cross members.

An additional object of the present invention is to provide a modular system for at least one of displaying and storing at least one article that includes a stop.

Another object of the present invention is to provide a modular system for at least one of displaying and storing at least one article that includes means for attaching one end of each of said at least pair of elongated support brackets to a respective one of said at least said pair of elongated mounting members.

A further object of the present invention is to provide a modular system for at least one of displaying and storing at least one article that includes means for securely attaching each of said at least said pair of elongated mounting members to a vertical surface.

Yet a further object of the present invention is to provide a modular system for at least one of displaying and storing at least one article that further includes means for supporting said at least said pair of elongated mounting members in a free standing manner.

An additional object of the present invention is to provide a modular system for at least one of displaying and storing at least one article that further includes at least a pair of elongated mounting members; a plurality of elongated cross members; plurality of first support brackets; a plurality of second support brackets; at least a pair of third support brackets; and a plurality of protrusions disposed in a spaced apart relationship on a top edge of each of said at least said pair of third support brackets.

Another object of the present invention is to provide a modular system for at least one of displaying and storing at least one article that further includes a substantially planar shelf disposed on top of a pair of said elongated cross members.

Yet another object of the present invention is to provide a bracket for supporting at least a pair of elongated cross members of a modular system for at least one of displaying and storing at least one article. The bracket comprises an elongated body; a first end configured for attachment to a mounting member employed within said modular system; and means for at least temporarily fixing said at least pair of elongated cross members in a spaced apart parallel relationship with each other.

An additional object of the present invention is to provide a bracket for supporting a pair of elongated cross members of a modular system for at least one of displaying and storing at least one article. The bracket comprises an elongated body; a first end configured for attachment to a mounting member employed within the modular system; and a stop disposed on a longitudinally opposite second end of the elongated body, wherein a portion of the stop protrudes above one edge of said elongated body.

An alternative object of the present invention is to provide an elongated cross member for a modular system for at least one of displaying and storing at least one article. The elongated cross member comprises an elongated body; and a pair of planar end stops.

Yet another object of the present invention is to provide an elongated cross member for a modular system for at least one of displaying and storing at least one article wherein the at least one article is a plurality of articles and the elongated cross member further includes means for positioning at least a portion of the plurality of articles at preselected distances from each other.

An additional object of the present invention is to provide an elongated cross member for a modular system for at least one of displaying and storing at least one article. The elongated cross member comprises an elongated body; and a plurality of protrusions extending from a surface of the elongated body in a spaced apart relationship with each other.

An additional object of the present invention is to provide a modular system for at least one of displaying and storing at least one article that further includes at least a pair of elongated mounting members; a plurality of elongated cross members; a plurality of first support brackets; a plurality of second support brackets; at least a pair of third support brackets; a plurality of protrusions disposed in a spaced apart relationship on a top edge of each of said at least said pair of third support brackets; and an attaching means.

Another object of the present invention is to provide a modular wine storage system that can be adapted to hold a wine bottle in five (5) different positions: label view (bottle laying on it's side, label facing the viewer); presentation view (bottle leaning back 45° degrees, label facing the sky); standing view (bottle standing upright, label facing the viewer); bottom view (bottle laying on it's side, bottom of bottle facing viewer, cork facing away from viewer, label facing the and cork view (bottle laying on side, cork facing viewer, bottom of bottle facing away viewer, label facing the sky.

It is a further object of the present invention to provide a wine rack that is modular, replaceable, and inexpensive to manufacture.

It is yet an additional object to provide a system which incorporates a full shelf feature that can be utilized as a counter surface, a table surface, a serving surface, or an integrated surface for storage and presentation of all the paraphernalia that goes along with enjoying wine such as, wine glasses, decanters, cork screws, reference books, etc.

Yet an another object of the present invention is to provide a modular wine storage and display system that requires up to 75% less mounting points on a wall.

Yet a further object of the present invention is to provide a modular wine display and storage system that is easy to clean and that will not deteriorate in damp or moist room.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
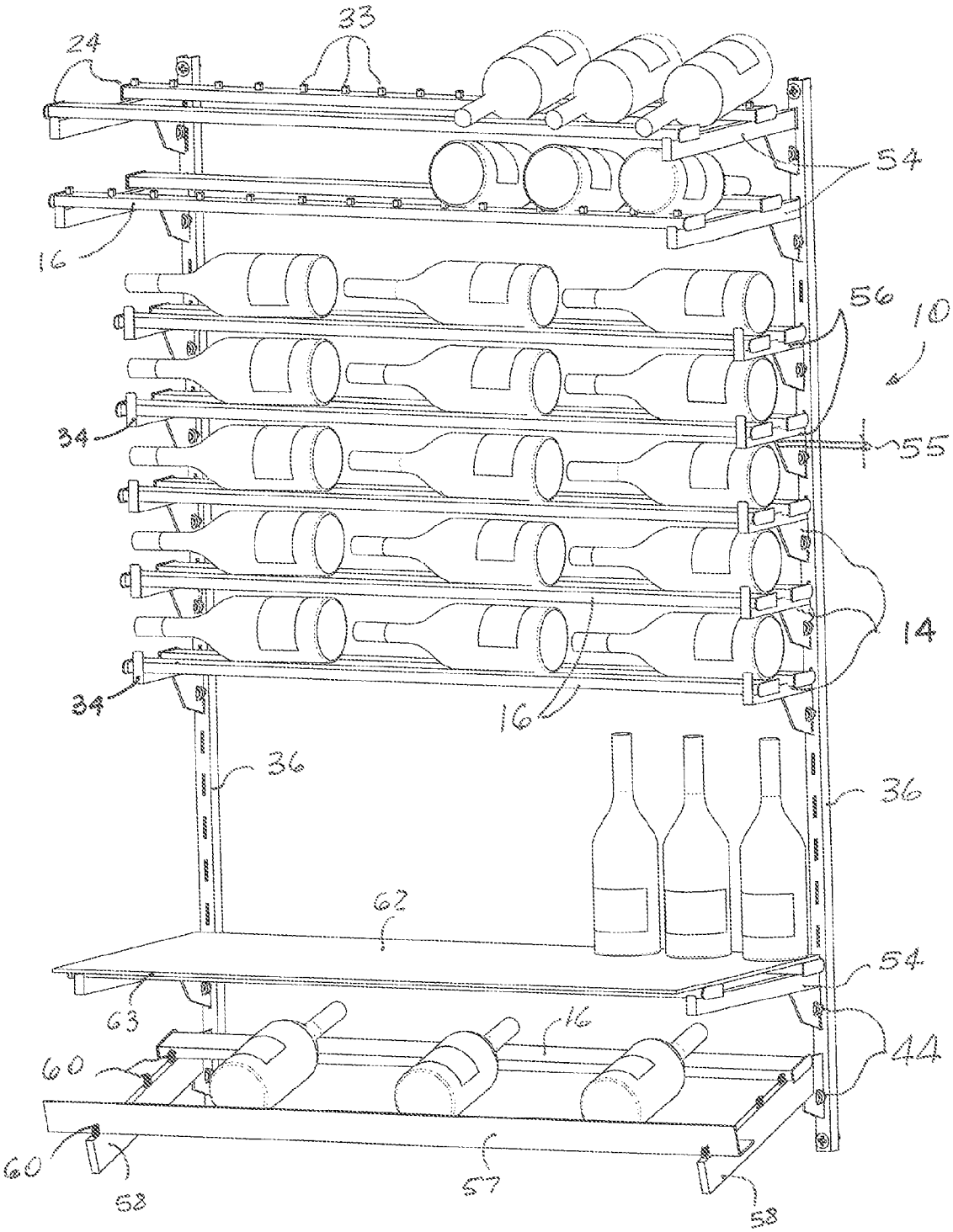
FIG. 1 is a perspective view of a modular system for storing and displaying articles.

Prior to proceeding to the more detailed description of the present invention, it should be noted that, for the sake of clarity and understanding, identical components which have identical functions have been identified with identical reference numerals throughout the several views illustrated in the drawing figures.

The best mode for carrying out the invention is presented in terms of its presently preferred embodiment, herein depicted within FIGS. 1 through 9. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The present invention describes a system for storing and displaying an article (herein described as the "system"), generally designated as 10, which provides means to store and display an article 12, particularly, wine bottles.

It is to be understood that the definition of an article 12 applies to any item that may be displayed or stored, for example bottles, such as wine bottles, liquor bottles or bottles used for cooking such as oil bottles. Additionally, the definition of article 12 may be further applied to other retail items such as shoes, purses, decorative household goods and other like items suitable for display and/or storage.

The present invention is illustrated and described in combination with a wine bottle, although it will be apparent to those skilled in the relevant art that the present invention may be applied to other bottles and articles and as such should not be interpreted as a limiting factor of the system of the present invention.

Reference is now made, to FIGS. 1-9, wherein the modular system 10 includes at least a pair of elongated support brackets 14, at least one elongated cross member 16 and means 18 for positioning each of the at least one elongated cross member 16 and the at least said pair of elongated support brackets 14 in a generally horizontal plane during use of the modular system 10.

The at least a pair of elongated support brackets 14 may be disposed in a spaced apart parallel relationship with each other. Each support bracket 14 may be of a generally tubular shape to afford weight reduction of the system 10, although other shapes are also contemplated in this document. Additionally, the at least one elongated cross member 16 is sized to at least span a distance between the at least pair of elongated support brackets 14 such that the at least one elongated cross member 16 may at least rest on a top edge 15 of each of the at least the pair of elongated support brackets 14 during use of said modular system 10.

The at least a pair of elongated support brackets 14 and the at least one elongated cross member 16 may each be made of any material, for example metal, wood or a polymeric material. In one embodiment, the at least a pair of elongated support brackets 14 and the one elongated cross member 16 are comprised of chrome plated steel.

Figure 3:
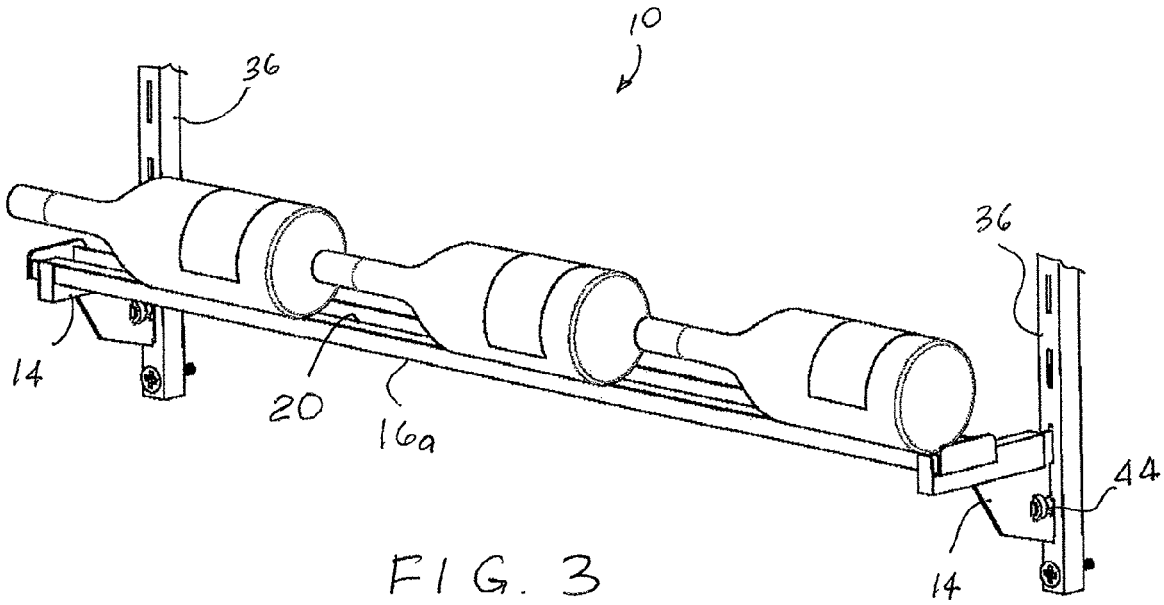
FIG. 3 is a partial perspective view of the system of FIG. 1, particularly illustrating a single elongated cross member.

In one embodiment of the present invention, as seen in FIG. 3, the at least one elongated cross member 16*a* may include a cavity 20 defined in one surface thereof throughout the length of the at least one elongated cross member 16*a*. The cavity 20 may have a concave shape in a direction normal to the length of the at least one elongated cross member. Additionally, the concave shape may be sized such that the at least one article 12 is at least partially disposed within the cavity 20 and thereby restrained from movement past the longitudinal edges of the at least one elongated cross member 16*a*. The embodiment of the invention as shown in FIG. 3 provides a label view when the article 12 that is displayed and/or stored is a bottle.

Figure 2:
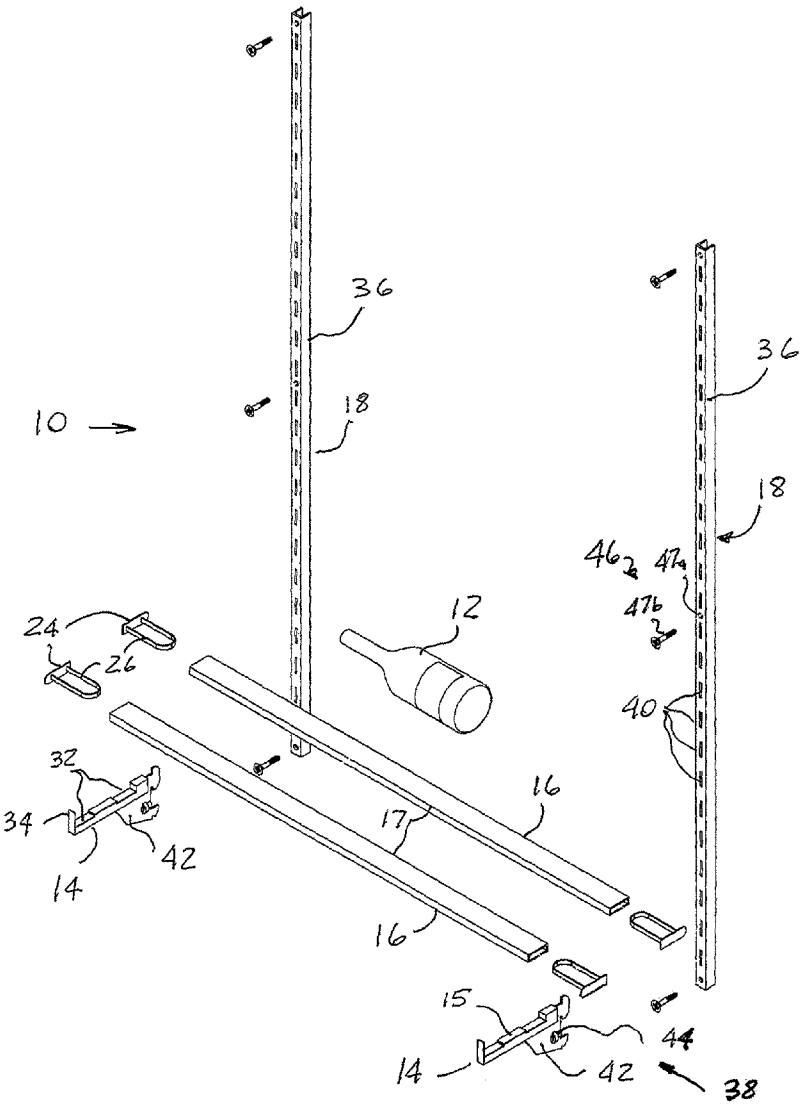
FIG. 2 is a partial exploded view of the modular system of FIG. 1.
Figure 4:
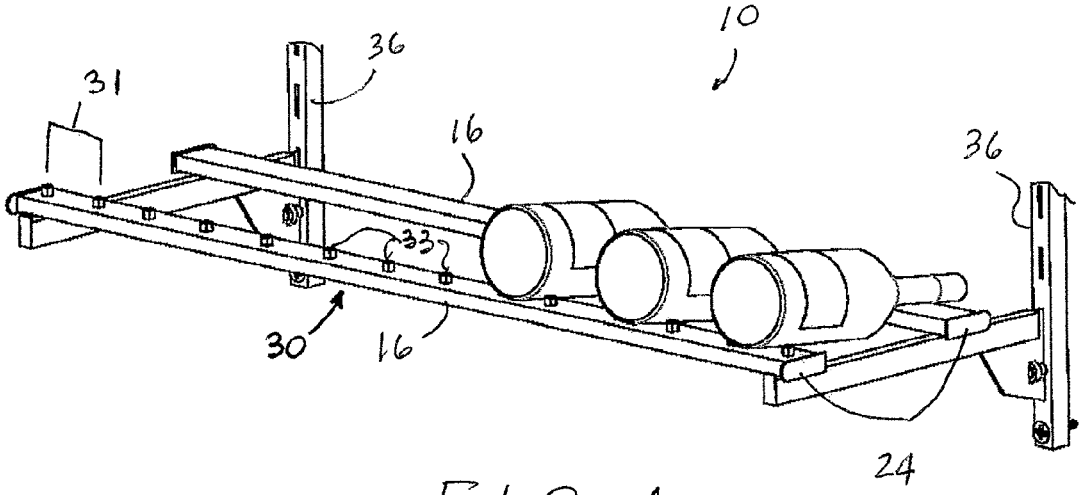
FIG. 4 is a partial perspective view of the system of FIG. 1, configured for a bottom view of articles.

As seen in FIGS. 2-4, the at least one elongated cross member 16 may be at least a pair of elongated cross members 16 disposed in a spaced apart parallel relationship with each other. Additionally, each of the at least said pair of elongated cross members 16 may include a pair of end stops 24 that are sized larger than a cross section of each of the at least said pair of elongated cross members 16 so as to prevent longitudinal movement of the articles 12 oriented in accordance with FIGS. 3 and 8. In one embodiment, each of the at least pair of elongated cross members 16 may be hollow and each of the pair of stops 24 may include a portion 26 sized and shaped for insertion into a respective hollow end. Preferably, the elongated cross members 16 are manufactured from tubular material. The pair of end stops 24 can be made of any material, for example metal, wood or a polymeric material. In one embodiment, the pair of end stops 24 are comprised of chrome plated steel.

Figure 5:
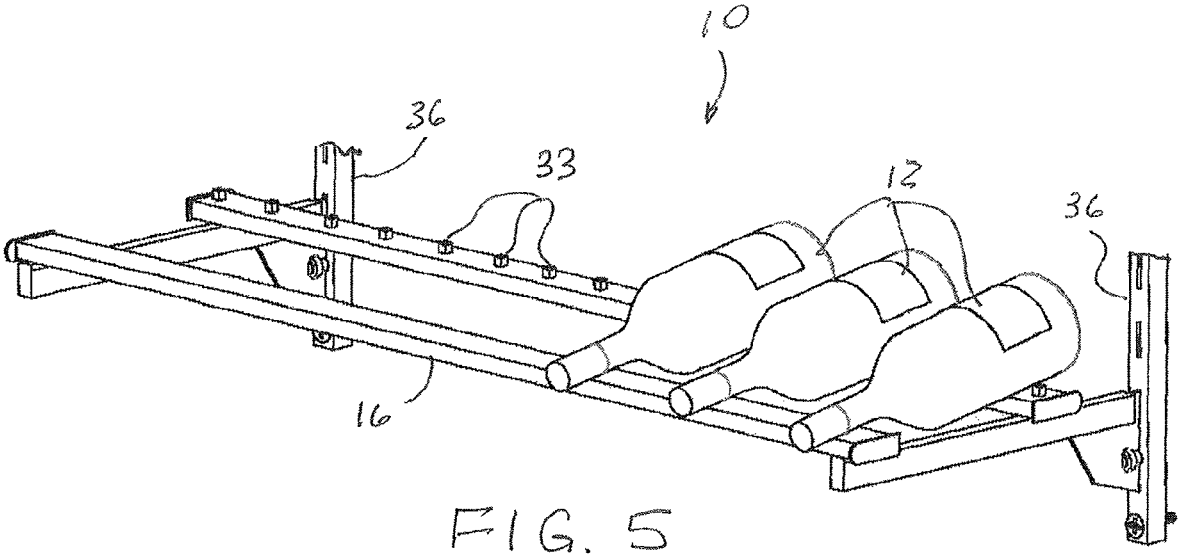
FIG. 5 is a partial perspective view of the system of FIG. 1 configured for a top view of articles.
Figure 6:
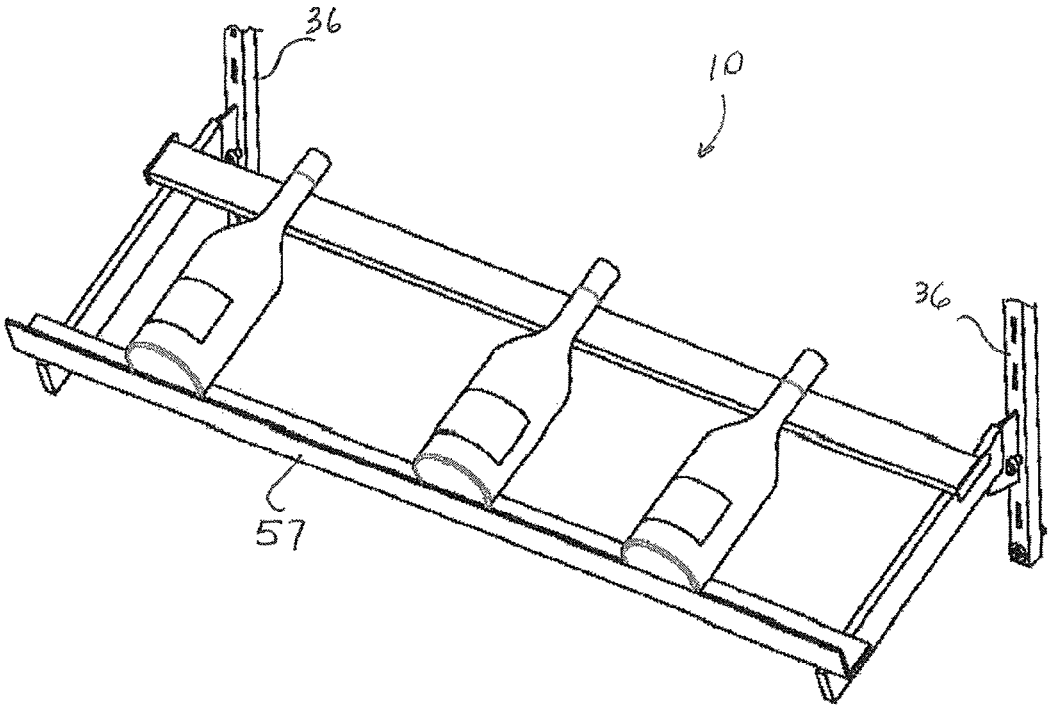
FIG. 6 is a partial perspective view of the system of FIG. 1 configured for a presentation view of articles in a generally horizontal position.

As best seen in FIGS. 4-6, the spaced apart parallel relationship of the at least said pair of elongated cross members 16 may be so configured and sized that a length of the at least one article 12 is oriented generally normal to a length of the at least said pair of elongated cross members 16. In this configuration, one end of the at least one article 12 is supported on one of said at least said pair of elongated cross members 16 and another end of said at least one article 12 is supported on another one of said at least said pair of elongated cross 16. The embodiment of the invention as shown in FIG. 5 provides a top or a cork view when the article 12 that is displayed and/or stored is a wine bottle.

As depicted in FIGS. 4 and 5, one embodiment of the present invention provides that the at least one article 12 may be a plurality of articles 12 and the modular system 10 may also include means 30 for positioning at least a portion of the plurality of articles 12 at preselected distances 31 from each other on at least the pair of elongated cross members 16. For example, the means 30 may include a plurality of protrusions 33 extending from a surface of at least one of the at least said pair of elongated cross members. The means 30 for positioning at least a portion of the plurality of articles at preselected distances from each other may be part of the elongated cross member 16 or alternatively may be separately constructed. Furthermore, in reference to FIG. 7*a*, the body of the elongated cross-member 16 may include a plurality of apertures or cavities 33*a* disposed in the spaced apart relationship with each other and wherein each of the plurality of protrusions 33 is sized and shaped to be received within one of the plurality of apertures or cavities 33*a*.

Figure 8:
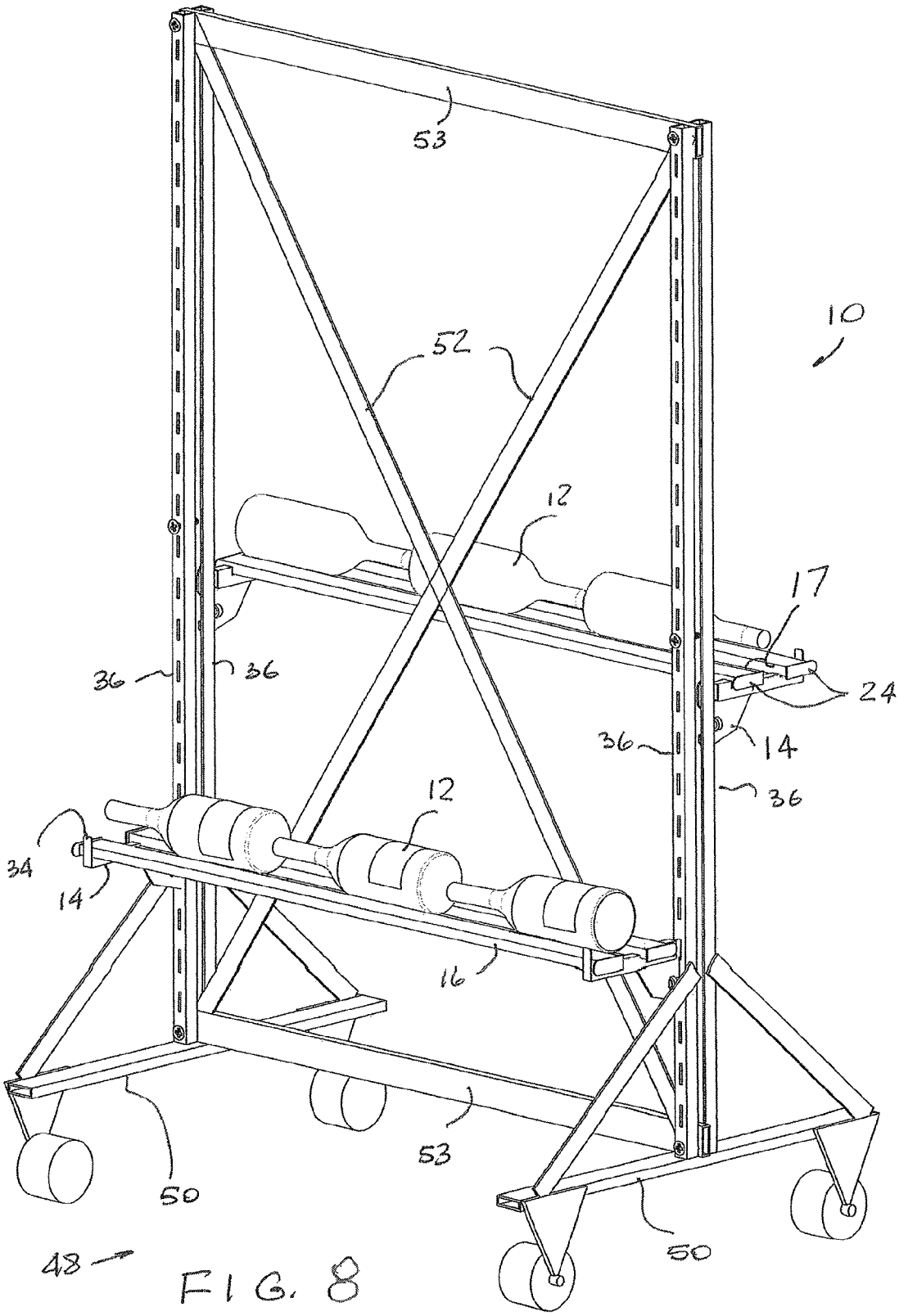
FIG. 8 illustrates a perspective view of the system of FIG. 1 configured as a free standing storage and display.

In further reference to FIGS. 1-2 and 8, the spaced apart parallel relationship of the at least said pair of elongated cross members 16 is so configured and sized that a length of said at least one article 12 is oriented along a length of said at least said pair of elongated cross members 16. In this embodiment, one longitudinal edge 17 of each of the at least said pair of elongated cross members 16 abuts a surface of the at least one article 12. In an alternative embodiment, the bracket 14 may be elongated such that it can accommodate additional cross members 16 and thereby hold multiple rows of articles 12.

Figure 7A:
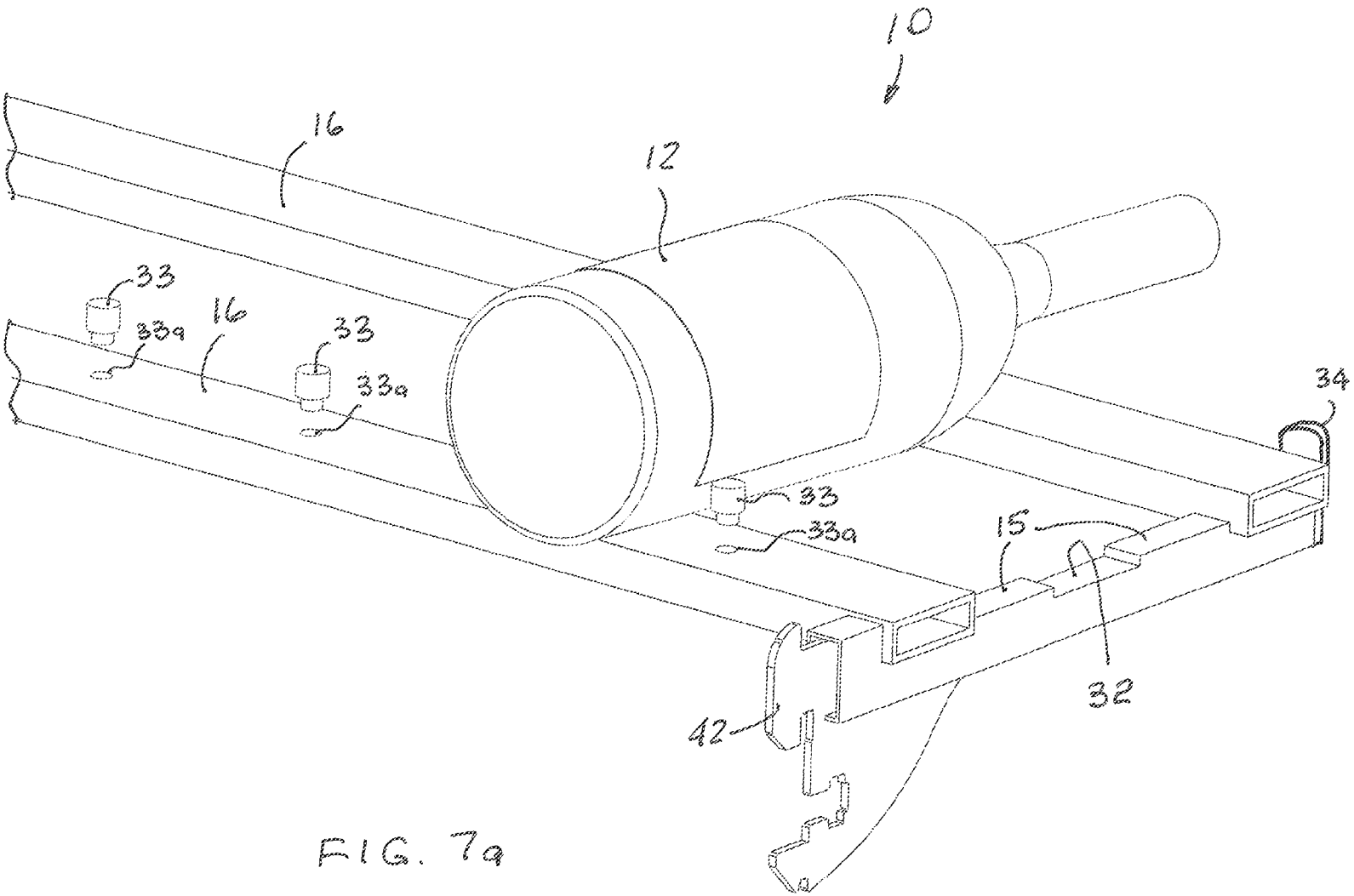
FIGS. 7*a-b* illustrate perspective views of a support bracket utilized with the system of FIG. 1.
Figure 7B:
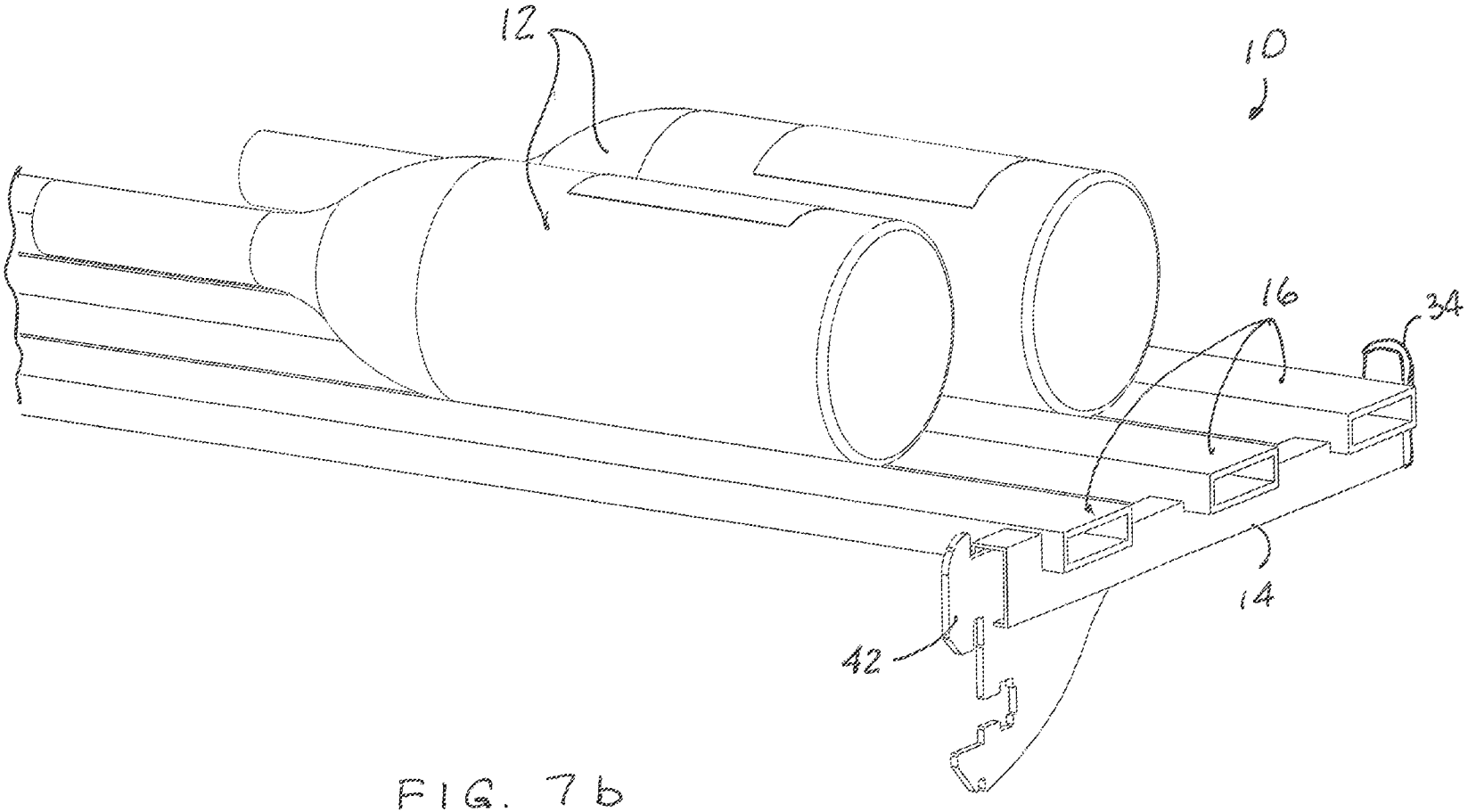

As best seen in FIGS. 1 and 7*a-b*, the modular system 10 may also include means 32 for at least temporarily fixing the at least said pair of elongated cross members 16 disposed generally horizontally in said spaced apart parallel relationship with each other. As shown in FIGS. 7*a-b*, the means 32 may include two or three cavities defined in the top edge 15 of each of the at least said pair of said brackets 14. Alternatively, the means 32 may include a plurality of the above described protrusions 33 extending from the top edge 15 of each of the at least pair of the brackets 14. It would be understood that the bottom edge of the pair of cavities 32 may define the top edge of the bracket 14, essentially replacing the cavities 32 with abutment containing the top edge 15 of FIGS. 7*a-b*.

In one embodiment, the system 10 includes a stop 34 disposed on a longitudinally opposite end of each of the at least pair of elongated support brackets 14 so as to eliminate dislodgement of the elongated cross-members 16. A portion of the stop 34 may protrude above the top edge 15 of each of the at least pair of elongated support brackets. The stop 34 may be an integral part of each of the at least pair of elongated support brackets 14 or alternatively may be separately constructed. The stop 34 is advantageous when the support bracket 14 is provided without any cavities 32. Alternatively, the cavity 32 may be positioned in close proximity to the free end of the support bracket 14, thus eliminating the need for stop 34.

The positioning means 18 of the modular system 10 may include at least a pair of elongated mounting members 36, conventionally referred to as "standards" that are disposed generally vertically in a spaced apart parallel relationship with each other during use of the modular system 10. The modular system 10 may further include means 38 for attaching one end of each elongated support bracket 14 to a respective elongated mounting member 36. For example, as seen in various figures, the attaching means 38 may include a plurality of apertures or cavities 40 defined in each of the at least the pair of elongated mounting members 36 in a spaced apart relationship with each other along a length thereof and at least one tab 42 extending from the one end of each of the at least the pair of elongated support brackets 14. The at least one tab 42 is sized and shaped for insertion into one of the plurality of apertures or cavities. The at least one tab 42 may be an integral part of each of the at least pair of elongated support brackets 14 or alternatively may be separately constructed.

The mounting members 36 may be made of any material, for example metal, wood or a polymeric material. In the presently preferred embodiment, mounting members 36 are comprised of chrome plated steel.

Additionally, the attaching means 38 may also include an optional tension mechanism 44 disposed at the one end of each of the at least the pair of elongated support brackets 14. The tension mechanism 44 may be manually operable to remove slack between the one end of each of the at least the pair of elongated support brackets 14 and a mating surface of the respective one of the at least the pair of elongated mounting members 36. In one embodiment of the present invention, the tension mechanism 44 may be a screw, nut, bolt or other like tension mechanism. In the presently preferred embodiment, the tension mechanism 44 is of the type as provided within a universal wall mount bracket from Gershel Bros. of Phoenix, Ariz.

In another embodiment, the modular system 10 comprises means 46 for securely attaching each of the at least the pair of elongated mounting members 36 to a vertical surface, for example a wall. The securely attaching means 46 may include at least a pair of apertures 47*a* formed through a thickness of each of the at least pair of elongated mounting members 36 and a plurality of screws or bolts 47*b* each sized for passage through a respective aperture 47*a*. The securely attaching means 46 may be a screw, bolt, nail or other like securely attaching means.

As seen in FIG. 8, the modular system may include means 48 for supporting the at least the pair of elongated mounting members in a free standing manner. The supporting means 48 may include at least one base member 50 to which a lower end of each of the at least the pair of elongated mounting members 36 is attached thereto. In a particular embodiment, the at least one base member 50 is at least a pair of base members 50 disposed in a spaced apart relationship with each other, each of the at least pair of base members 50 is operatively positioned at each lower end of a respective one of the at least pair of elongated mounting members 36. In further reference to FIG. 8, a pair of mounting member 36 are positioned in a back-to-back relationship with each other so as to store and/or display articles 12 on both vertical surfaces of the system 10. Optional cross braces 52 and horizontal braces 53 are also contemplated within the instant invention.

In further reference to FIG. 1, such Figure provides one example of an arrangement of the modular system 10 that comprises at least a pair of elongated mounting members 36; a plurality of elongated cross members 16; a plurality of first support brackets 14; a plurality of second support brackets 56; at least a pair of third support brackets 58; and a plurality of protrusions 60 disposed in a spaced apart relationship on a top edge of each of the at least the pair of third support brackets 58. Brackets 14, 56 and 58 preferably are similarly constructed and have identical attachment means 38.

The at least a pair of elongated mounting members 36 are disposed generally vertically in a spaced apart parallel relationship with each other during use of the modular system 10.

The plurality of first support brackets 14 each extends generally horizontally from and normal to a respective one of the at least the pair of elongated mounting members 36 and are sized so as to position at least another pair of the plurality of elongated cross members 16 in a first spaced apart parallel relationship with each other. The length of the at least one article 12 is oriented along a length of the at least another pair of elongated cross members 16. Additionally, one longitudinal edge of each of the at least another pair of elongated cross members 16 abuts a surface of the at least one article 12. The plurality of first support brackets 14 may be made of any material, for example metal, wood or a polymeric material. In one embodiment, plurality of first support brackets are comprised of chrome plated steel.

The plurality of second support brackets 56 extend generally horizontally from and normal to the respective one of the at least the pair of elongated mounting members 36 and are sized so as to position at least another pair of the plurality of elongated cross members 16 in a second spaced apart parallel relationship with each other, whereby a length of the at least one article 12 is oriented generally normal to a length of the at least one pair of elongated cross members 16, whereby one end of the at least one article 12 is supported on one of the at least one pair of elongated cross members 16 and another end of the at least one article is supported on another one of the at least one pair of elongated cross members 16. Second brackets 56 may include the above described cavities 32. The plurality of second support brackets 56 may be made of any material, for example metal, wood or a polymeric material. In one embodiment, plurality of second support brackets 56 are comprised of chrome plated steel.

In this arrangement, the apertures 40 are spaced at a preselected distance from each other and support brackets 14 and 56 are dimensioned and sized so as to minimize clearance 55 between the surface of the article 12 and the bottom edge of the respective upper support bracket 56.

Each of the at least a pair of third support brackets 58 extends at an angle from the respective one of the at least the pair of elongated mounting members 36 so that a distal end of each of the at least the pair of third support brackets 58 is disposed lower in a vertical direction then a proximal end thereof being disposed in close proximity to the respective one of the at least the pair of elongated mounting members 36. The plurality of third support brackets 58 may be made of any material, for example metal, wood or a polymeric material. In one embodiment, plurality of third support brackets 58 are comprised of chrome plated steel.

The plurality of protrusions 60 are disposed in a spaced apart relationship on a top edge of each of the at least the pair of third support brackets 58, whereby at least a further pair of the plurality of elongated members 16 positioned in a third spaced apart parallel relationship with each other on the top edge of each of the at least the pair of third support brackets positions the at least one article 12 at an incline relative to a plane defined by the at least the pair of elongated mounting members 36. The plurality of protrusions 60 may be part of each of the at least pair of third elongated support brackets 58 or alternatively may be separately constructed. One of the pair of elongated members 16 has a lip 57 so as to restrain articles 12 from movement.

As is further seen in FIG. 1, the system 10 of this the present invention may also include a substantially planar shelf 62 disposed on top of a pair of the elongated cross members 16. Accordingly, the thickness of elongated members 16 is so selected that upper surface thereof protrudes above the top edge of the stop 34 allowing the front edge 63 of the shelf 62 to extend in a forward direction past the stops 34 if desired for a particular application. The planar shelf 62 may be made of any material, for example metal, wood or a polymeric material or glass.

The instant invention contemplates that the support bracket 14 may be also adapted with three (3) cavities 32 or, alternatively, four (4) protrusions 33 so as to support and space three (3) elongated members 16 and provide two (2) spaced apart rows of articles 12 aligned and oriented in a longitudinal direction of the elongated members 16.

The system 10 of FIG. 1 defines a rack for storage and display purposes. The instant invention further contemplates that a plurality of systems 10 of FIG. 1 can be mounted in a side-by-side relationship with each other in applications utilizing large size walls, for example as in stores, basements and the like spaces. It is further contemplates that arrangement of elongated cross members 16 may differ for each of the plurality of systems 10 so as to fit particular needs or styles of the user. For example, more than one shelf 62 may be used for tasting purposes or for storing and displaying wine glasses and decanters. Or, more than one pair of third brackets 58 may be used to display rare wine bottles. In another example, each system 10 can be arranged in accordance with FIGS. 4-5 so as to store the maximum number of articles 12 possible.

Figure 9:
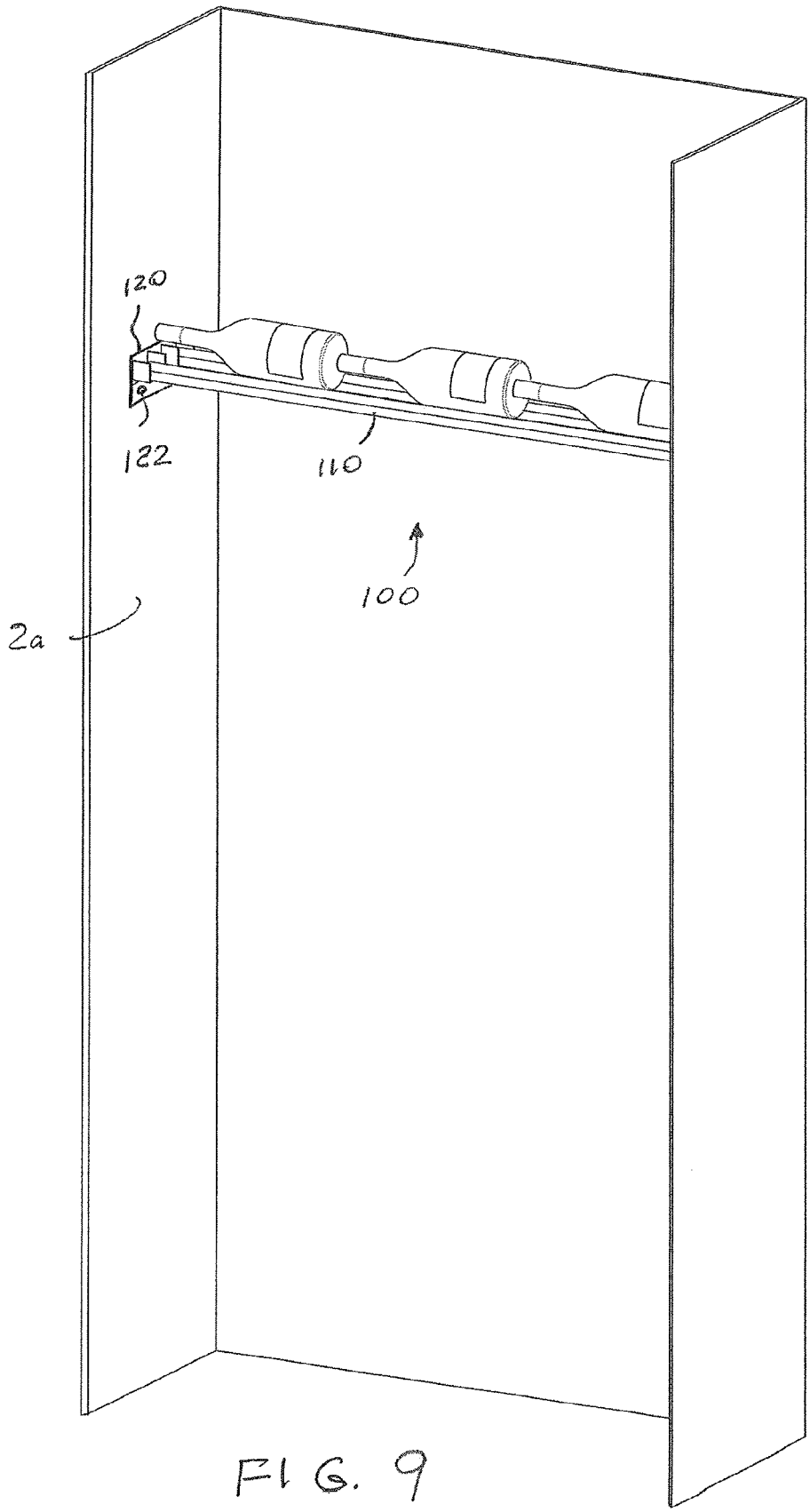
FIG. 9 illustrates a perspective view of another embodiment for storing and displaying articles.

In another embodiment, shown in FIG. 9, the instant invention contemplates a system, generally designated as 100, wherein elongated cross members 110 may be used to span the width between wall portions 2*a* without use of the standards 36. In this embodiment, the end members 24 would be enlarged, as represented by reference numerals 120, and provided with mounting apertures 122. It is further contemplated to arrange elongated cross members 110 in accordance with the above described embodiments.

Thus, the instant invention provides a novel arrangement for storing and displaying articles that affords the user to economically and effectively arrange the articles 12 in accordance with personal styles or needs and overcomes the disadvantages of conventional storage systems.

For example, if the system 10 is to be used only for storage purposes, user may choose the arrangement of FIG. 4 or 5 so as to maximize the available storage space.

Although the present invention has been shown in terms of modular system for storing and displaying wine bottles, it will be apparent to those skilled in the art, that the present invention may be applied to other articles and items.

The instant invention also contemplates that elongated cross members 16 and various support brackets may be utilized independently from each other in other systems. For example, brackets 14 may be employed with a conventional storage system utilizing wire shelves.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In a combination with at least one elongated article having a length thereof being greater than a cross-sectional area in a plane being normal to said length, a modular system for at least one of displaying and storing said at least one article having the length thereof being greater than the width or the diameter thereof, said modular system comprising:

(a) at least a pair of elongated support brackets disposed in a spaced apart parallel relationship with each other;

(b) at least one elongated cross member being sized to at least span a distance between said at least said pair of elongated support brackets, said at least one elongated cross member having an exterior surface portion thereof at least directly resting on a top edge surface of each of said at least said pair of elongated support brackets during use of said modular system, said at least one elongated cross member includes a cavity defined in one surface thereof throughout a length of said at least one elongated cross member, said cavity having a concave shape in a direction normal to said length of said at least one elongated cross member, said concave shape is so sized that said at least one article, being at least partially disposed within said cavity, is restrained from movement past longitudinal edges of said at least one elongated cross member; and (c) means for positioning each of said at least one elongated cross member and said at least said pair of elongated support brackets in a generally horizontal plane during use of said modular system.

2. The combination of claim 1, wherein said at least one elongated cross member is at least a pair of elongated cross members disposed in a spaced apart parallel relationship with each other.

3. The combination of claim 2, further including means for at least temporarily fixing said at least said pair of elongated cross members disposed generally horizontally in said spaced apart parallel relationship with each other.

4. The combination of claim 3, wherein said means includes a pair of cavities defined in a top edge of each of said at least said pair of said brackets.

5. The combination of claim 3, wherein said means includes a plurality of protrusions extending from a top edge of each of said at least said pair of said brackets.

6. The modular system of claim 5, wherein said plurality of protrusions are formed integral with each of said at least said pair of brackets.

7. The combination of claim 2, wherein said system includes a stop disposed on a longitudinally opposite end of each of said at least said pair of elongated support brackets, wherein a portion of said stop protrudes above a top edge of each of said at least said pair of elongated support brackets.

8. The combination of claim 1, wherein said means for positioning includes at least a pair of elongated mounting members disposed generally vertically in a spaced apart parallel relationship with each other during use of said modular system.

9. The combination of claim 8, further comprising means for attaching one end of each of said at least said pair of elongated support brackets to a respective one of said at least said pair of elongated mounting members.

10. The combination of claim 9, wherein said means for attaching includes a plurality of apertures or cavities defined in each of said at least said pair of elongated mounting members in a spaced apart relationship with each other along a length thereof and at least one tab extending from said one end of each of said at least said pair of elongated support brackets, said at least one tab is sized and shaped for insertion into one of said plurality of apertures or cavities.

11. The combination of claim 10, wherein said attaching means further includes a tension mechanism disposed at said one end of each of said at least said pair of elongated support brackets, said tension mechanism being manually operable to remove slack between said one end of each of said at least said pair of elongated support brackets and a mating surface of said respective one of said at least said pair of elongated mounting members.

12. The combination of claim 8, further comprising means for securely attaching each of said at least said pair of elongated mounting members to a vertical surface.

13. The combination of claim 12, wherein said means for securely attaching includes at least a pair of apertures formed through a thickness of each of said at least said pair of elongated mounting members and a plurality of screws or bolts each sized for passage through a respective aperture.

14. A modular system for at least one of displaying and storing at least one article, said modular system comprising:

(a) at least a pair of elongated mounting members disposed generally vertically in a spaced apart parallel relationship with each other during use of said modular system;

(b) a plurality of elongated cross members;

(c) a plurality of first support brackets, each extending generally horizontally from and normal to a respective one of said at least said pair of elongated mounting members and being sized so as to position at least one pair of said plurality of elongated cross members in a first spaced apart parallel relationship with each other, whereby a length of said at least one article is oriented generally normal to a length of said at least one pair of elongated cross members, whereby one end of said at least one article is supported on one of said at least one pair of elongated cross members and another end of said at least one article is supported on another one of said at least one pair of elongated cross members;

(d) a plurality of second support brackets, each extending generally horizontally from and normal to a respective one of said at least said pair of elongated mounting members and being sized so as to position at least another pair of said plurality of elongated cross members in a second spaced apart parallel relationship with each other, whereby said length of said at least one article is oriented along a length of said at least another pair of elongated cross members, and wherein one longitudinal edge of said each of said at least another pair of elongated cross members abuts a surface of said at least one article;

(e) at least a pair of third support brackets, each extending at an angle from a respective one of said at least said pair of elongated mounting members so that a distal end of each of said at least said pair of third support brackets is disposed lower in a vertical direction then a proximal end thereof being disposed in close proximity to said respective one of said at least said pair of elongated mounting members; and (f) a plurality of protrusions disposed in a spaced apart relationship on a top edge of each of said at least said pair of third support brackets, whereby at least a further pair of said plurality of elongated members positioned in a third spaced apart parallel relationship with each other on said top edge of each of said at least said pair of third support brackets positions said at least one article at an incline relative to a plane defined by said at least said pair of elongated mounting members.

15. The modular system of claim 14, wherein each of the pairs of elongated cross members includes a pair of end stops, each of said pair of end stops sized larger than a cross section of each of said pairs of elongated cross members.

16. The modular system of claim 15, wherein each end of each of said pairs of elongated cross members is a hollow end and wherein each of said pair of stops includes a portion sized and shaped for insertion into a respective one of the hollow ends.

17. The modular system of claim 14, further including a plurality of protrusions extending from a surface of one of said at least one pair of said plurality of elongated cross members.

18. The modular system of claim 14, further comprising means for supporting said at least said pair of elongated mounting members in a free standing manner.

19. The modular system of claim 18, wherein said supporting means includes at least one base member and wherein a lower end of each of said at least said pair of elongated mounting members is attached thereto.

20. The modular system of claim 18, wherein said at least one base member is at least a pair of base members disposed in a spaced apart relationship with each other, each of said at least pair of base members is operatively positioned at each lower end of a respective one of said at least said pair of elongated mounting members.

21. The modular system of claim 14, further comprising a substantially planar shelf disposed on top of one of the pairs of said plurality of said elongated cross members.

22. The modular system of claim 14, wherein each of said plurality of first brackets includes a pair of cavities defined in one edge thereof, each sized and shaped so as to receive a respective one of said at least one pair of elongated cross members therewithin.

23. The modular system of claim 14, wherein each of said plurality of first brackets includes a plurality of protrusions extending from one edge thereof.

24. The modular system of claim 14, wherein each of said plurality of first and second brackets includes an elongated body and a stop disposed on a distal end thereof, wherein a portion of said stop protrudes above one edge of said elongated body.

25. The modular system of claim 14, wherein each of said plurality of elongated cross members is hollow throughout a length thereof.

26. The modular system of claim 14, wherein each of said at least one pair of said plurality of elongated cross members includes a plurality of apertures or cavities disposed in said spaced apart relationship with each other and a plurality of protrusions, each protrusion is sized to be received within one of said plurality of apertures or cavities.

27. A modular system for at least one of displaying and storing at least one article, said modular system comprising:

(a) at least a pair of elongated mounting members disposed generally vertically in a spaced apart parallel relationship with each other during use of said modular system;

(b) a plurality of elongated cross members;

(c) a plurality of first support brackets, each extending generally horizontally from and normal to a respective one of said at least said pair of elongated mounting members and being sized so as to position at least one pair of said plurality of elongated cross members in a first spaced apart parallel relationship with each other, whereby a length of said at least one article is oriented generally normal to a length of said at least one pair of elongated cross members, whereby one end of said at least one article is supported on one of said at least one pair of elongated cross members and another end of said at least one article is supported on another one of said at least one pair of elongated cross members;

(d) a plurality of second support brackets, each extending generally horizontally from and normal to a respective one of said at least said pair of elongated mounting members and being sized so as to position at least another pair of said plurality of elongated cross members in a second spaced apart parallel relationship with each other, whereby said length of said at least one article is oriented along a length of said at least another pair of elongated cross members, and wherein one longitudinal edge of each of said at least another pair of elongated cross members abuts a surface of said at least one article;

(e) at least a pair of third support brackets, each extending at an angle from a respective one of said at least said pair of elongated mounting members so that a distal end of each of said at least said pair of third support brackets is disposed lower in a vertical direction then a proximal end thereof being disposed in close proximity to said respective one of said at least said pair of elongated mounting members;

(f) a plurality of protrusions disposed in a spaced apart relationship on a top edge of each of said at least said pair of third support brackets, whereby at least a further pair of said plurality of elongated cross members is positioned in a third spaced apart parallel relationship with each other on said top edge of each of said at least said pair of third support brackets positions said at least one article at an incline relative to a plane defined by said at least said pair of elongated mounting members;

(g) means for attaching one end of each of said first, second and third support brackets to a respective one of said at least said pair of elongated mounting members, wherein said attaching means includes:

i. a plurality of apertures or cavities defined in each of said at least said pair of elongated mounting members in a spaced apart relationship with each other along a length thereof;

ii. at least one tab extending from said one end of each of said plurality of elongated first support brackets, said plurality of elongated second support brackets, and said at least said pair of elongated third brackets, said at least one tab is sized and shaped for insertion into one of said plurality of apertures or cavities; and iii. a tension mechanism disposed at said one end of each of said plurality of elongated first support brackets, said plurality of elongated second support brackets, and said at least said pair of elongated third brackets, said tension mechanism being manually operable to remove a slack between said one end of each of said plurality of elongated first support brackets, said plurality of elongated second support brackets, and said at least said pair of elongated third brackets and a mating surface of said respective one of said at least said pair of elongated mounting members.

* * * * *